US006485060B2

(12) United States Patent
Nada et al.

(10) Patent No.: US 6,485,060 B2
(45) Date of Patent: Nov. 26, 2002

(54) PLASTIC FOLDER FOR RETAINING SHEETS OF PAPER

(75) Inventors: Masaharu Nada, Osaka (JP); Katsuyuki Tono, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 0 days.

(21) Appl. No.: 09/785,224

(22) Filed: Feb. 20, 2001

(65) Prior Publication Data

US 2002/0113427 A1 Aug. 22, 2002

(51) Int. Cl.[7] ..... B42D 1/00; B42D 3/10; B42D 17/00; B42F 1/00

(52) U.S. Cl. ..... 281/45; 281/15.1; 281/21.1; 281/29; 281/31; 281/36; 281/37; 281/51; D19/26

(58) Field of Search ..... 281/15.1, 21.1, 281/29, 31, 36, 37, 51, 45; D19/26

(56) References Cited

U.S. PATENT DOCUMENTS

| | | | | | |
|---|---|---|---|---|---|
| 4,629,070 | A | | 12/1986 | Roberg | 206/455 |
| D321,977 | S | * | 2/1991 | Wyant | 281/19.1 |
| 5,421,453 | A | | 6/1995 | Harrer et al. | 206/312 |
| 5,435,598 | A | * | 7/1995 | Robinson | 281/21.1 |
| 5,683,111 | A | * | 11/1997 | Bass et al. | 281/21.1 |
| 5,727,816 | A | * | 3/1998 | Ong | 281/21.1 |
| 6,126,201 | A | * | 10/2000 | Pace et al. | 281/21.1 |
| D447,170 | S | * | 8/2001 | Wolff et al. | D19/26 |

FOREIGN PATENT DOCUMENTS

| | | | |
|---|---|---|---|
| WO | 90/04524 | 5/1990 | B24F/7/04 |

OTHER PUBLICATIONS

Kokuyo Co., LTD., "Kokuyo Stationery Catalog ('98 Edition): Clear Cover File", Dec. 1997, pp. 89, 720: Japan.

Kokuyo Co., LTD., "Supplemental Description for Product Shown in Kokuyo 1998 Catalog", product description, Jan. 24, 2002, unpublished.

Kokuyo Office Supplies 2000 Catalog, p. 93 with partial translation.

* cited by examiner

*Primary Examiner*—A. L. Wellington
*Assistant Examiner*—Mark T. Henderson
(74) *Attorney, Agent, or Firm*—Sughrue Mion, PLLC

(57) ABSTRACT

A plastic folder, for holding sheets of paper, which includes a front cover and a back cover connected by a hinge. The hinge includes a first fold line adjacent to the front cover, and a second fold line adjacent to the back cover, and a third fold line intermediate the first and second fold lines, thereby dividing the hinge into a first portion adjacent to the front cover and a second portion adjacent to the back cover. A pair of weld areas are disposed in the hinge so as to connect the first hinge portion to the second hinge portion. The weld areas are spaced from one another so as to produce a holding force on the paper inserted into the plastic folder. The first and second fold lines, together with the welded areas, produce a plastic folder that more securely, and durably, holds paper therein.

10 Claims, 3 Drawing Sheets

PLASTIC FOLDER FOR RETAINING SHEETS OF PAPER

BACKGROUND

1. Field of the Invention

The present invention relates to plastic folders and, more particularly, to plastic folders for carrying paper and records.

2. Related Art

WO 90/04524 discloses a plastic folder for holding sheets of paper. The plastic folder disclosed therein includes joined areas, or welds, for connecting a front side and a back side in the vicinity of the margin of a sheet of paper held within the folder. Further, the folder includes cuts adjacent to the joined areas in order to allow the interval between the joined areas to vary while allowing the sheets held in the folder to remain flat. However, this reference only discloses one fold line along the spine between the front and back sides. Thus, when either the front or back side is opened, it places a stress on the joined area, as well as tends to bow the folder thereby making it easier for the sheets to come out thereof.

SUMMARY OF THE INVENTION

The present invention is designed to overcome the drawbacks of the related art. Further, it is an object of the present invention to more securely, and durably, retain sheets of paper within a plastic folder. In order to improve the paper retention and durability of the plastic folder, an advantageous combination of weld areas and fold lines is used. Further, the shape of the weld areas contributes to improved paper retention, durability, and esthetic appearance of the folder.

In order to achieve the above and other objects and advantages of the invention, a plastic folder, for retaining sheets of paper, includes:

a front cover;

a back cover;

a hinge section between the front cover and the back cover, wherein the hinge section includes a first fold line adjacent the front cover, a second fold line adjacent the back cover, and a third fold line intermediate the first and second fold lines, the third fold line forming a spine so that the front cover is disposed over the back cover and so that the first fold line is over the second fold line, wherein a first hinge portion is disposed between the third fold line and the first fold line, whereas a second hinge portion is disposed between the third fold line and the second fold line;

a first weld area disposed on the hinge section as well as between the spine and the first fold line, wherein the first weld area connects the first portion of the hinge to the second portion of the hinge;

a second weld area disposed on the hinge section as well as between the spine and the first fold line, wherein the second weld area connects the first portion of the hinge to the second portion of the hinge, wherein the second weld area is disposed at a first distance in the direction of the spine from the first weld area, the first distance being smaller than a length of an edge of a sheet of paper to be disposed along the spine so that the sheet of paper is held within the plastic folder by the first and second weld areas.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF PREFERRED EMBODIMENTS OF THE INVENTION

The present invention is directed to a plastic folder for holding sheets of paper, wherein the paper retention, and durability, are improved. In order to improve the paper retention and durability of the plastic folder, an advantageous combination of weld areas and fold lines is used to make the plastic folder from a plastic blank. Further, the shape of the weld areas contributes to improved paper retention, durability, and esthetic appearance of the folder. Specific, non-limiting, embodiments of the plastic folder will now be described with reference to the Figures.

Figure 1:
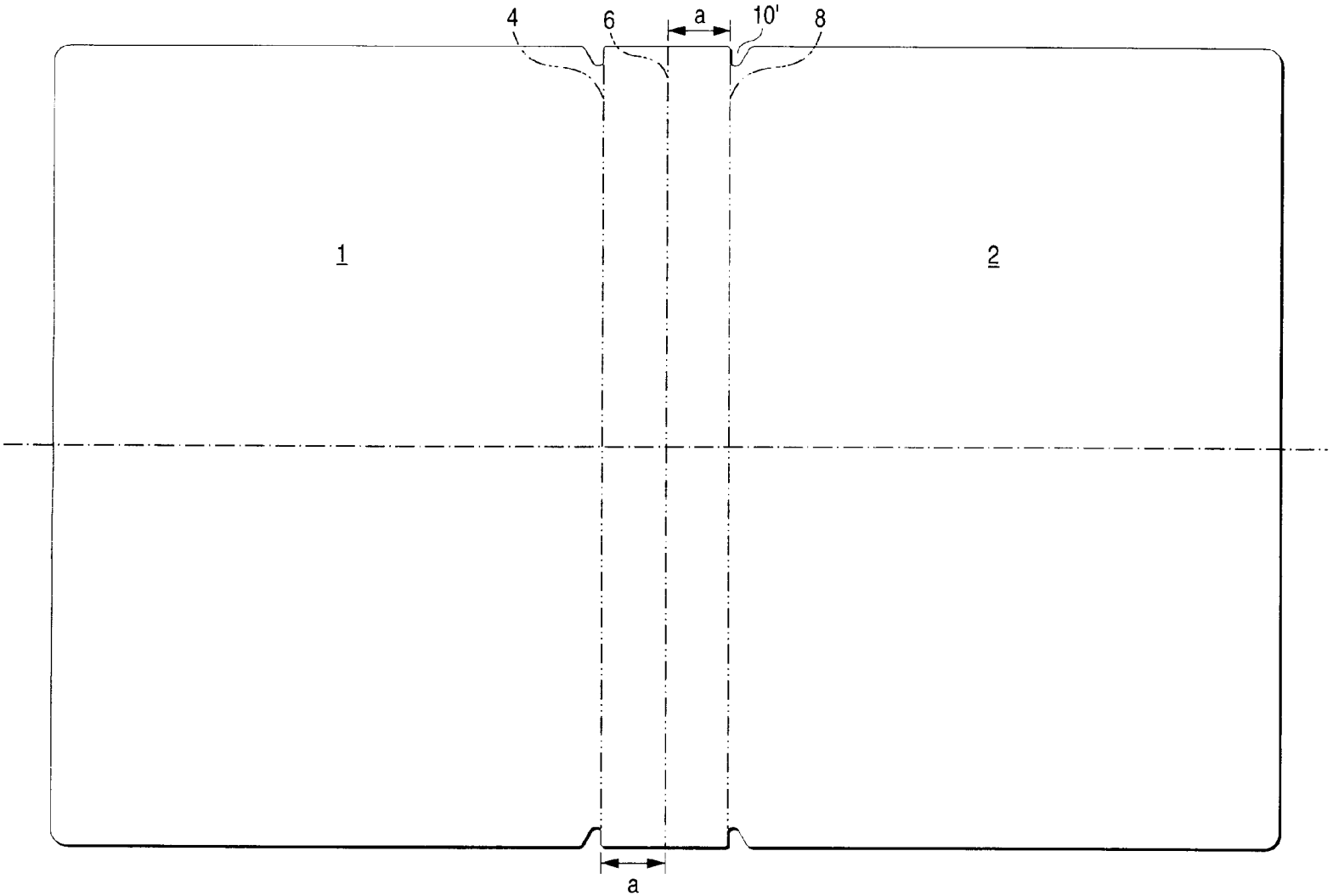
FIG. 1 is a flat layout of a blank from which a plastic folder according to the present invention is made.

FIG. 1 shows a plastic blank from which the folder is made. The blank includes a front cover 1, a back cover 2, and a hinge section therebetween. The hinge section includes three parallel fold lines 4, 6, 8 that divide the hinge section into a first portion and a second portion. The first portion is located between the fold lines 4,6 and is adjacent the front cover 1, whereas the second portion is located between the fold lines 6,8 and is adjacent the back cover 2. The fold line 6 is the mid-point of the plastic blank so that when the covers are folded about the fold line 6, the front cover 1 is directly on top of the back cover 2, the fold line 4 is directly on top of the fold line 8, and the first hinge portion is directly on top of the second hinge portion. Each of the fold lines 4 and 8 is spaced at a distance of a from the fold line 6, wherein the distance a preferably is the distance corresponding to, or less than, the margin of the sheets of paper that are to be inserted into the plastic folder so that the information contained on the paper sheets easily can be read. Adjacent the fold lines 4 and 8, cutouts 10' are formed. As shown in FIG. 1, the cutouts 10' include one sloped side, and one side arranged substantially parallel to the fold line 6. The purpose of cutouts 10' will be described later.

The plastic blank may be made of any suitable plastic sheet as is known in the industry and, typically, is made of polypropylene. Other suitable materials are, for example, polyethylene, elastic copolymerisates or various laminated foils, polyvinyl chloride, polyester, or triacetate. Additionally, although the covers have been labeled as front and rear, such is only for convenience of explanation, and either cover may be used as the front cover. Further, the term "fold line" is used in a generic sense to refer to any one of several structures known in the art for producing a line in sheet material along which a fold easily is made. Examples of fold lines are cut scores, score lines, and perforation lines. As is well known in the art, a cut score is generally formed having a height that cuts only partially through the sheet (e.g. 50% through the sheet) to compress the material along the score line without removing material. A cut score preferentially encourages folding in the direction away from the cut. A score line is similar to a cut score, but is formed by making an indentation in the sheet material that produces a bulge of material on one side of the sheet, wherein the indentation is formed by knives that cut holes in the sheet material along a perforation line.

In order to form a plastic folder, the blank is folded about fold line 6 so that the front cover 1 is on top of the rear cover 2, and so that the fold line 4 is on top of the fold line 8. When the blank is thusly folded, the fold line 6 becomes a spine 12. Welds are then formed in weld areas 20, 20' between the spine 12 and the fold lines 4,8. See FIGS. 2 and 5.

Figure 2:
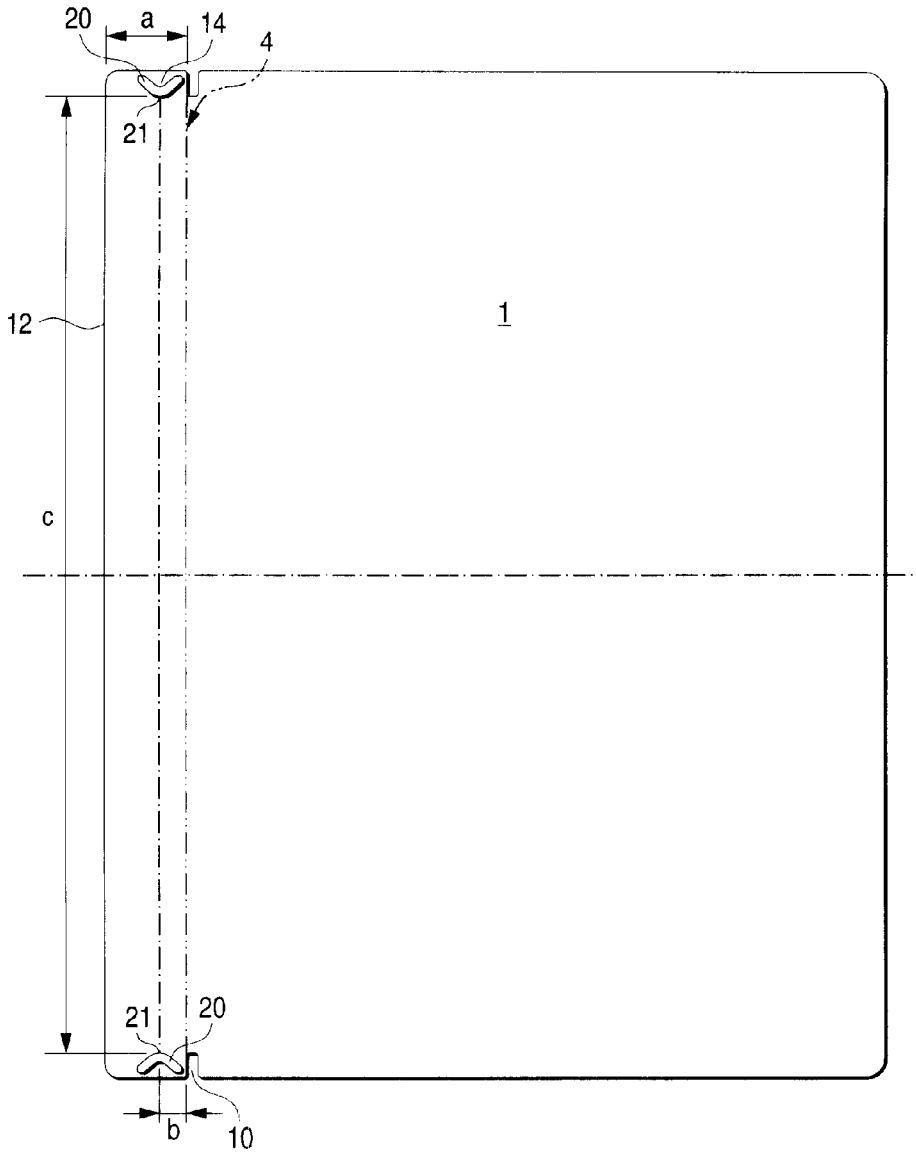
FIG. 2 is a flat layout of a plastic folder according to one embodiment of the present invention.

A first embodiment of the present invention will now be described with reference to FIGS. 2–4. FIG. 2 shows a first embodiment of the invention as including weld areas 20, spine 12, fold lines 4,8 (wherein fold line 8 is directly beneath fold line 4), and cutouts 10.

Figure 3:
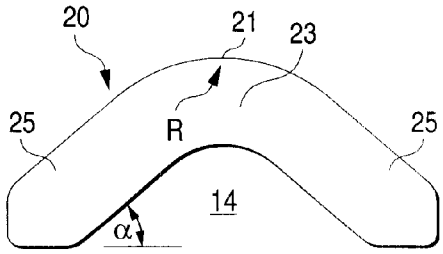
FIG. 3 is a blown-up, schematic, view of a weld area as shown in FIG. 2.
Figure 4:
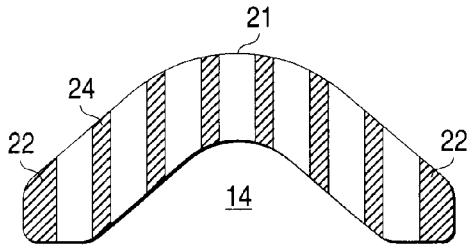
FIG. 4 is a blown-up, schematic, view of a weld area as shown in FIG. 2, wherein the pattern of welded portions is shown.

The weld areas 20 are shown in a blown-up manner in FIGS. 3 and 4, wherein FIG. 3 shows the overall configuration of the weld areas 20, and FIG. 4 shows the pattern of welded portions 22,24 within the weld area 20. Each of the weld areas 20 generally includes a contact point 21, an arcuate portion 23, and linear portions 25, which are linear extensions of the arcuate portion 23. The arcuate portion 23 has a radius of R, and is formed so that the apex of the arcuate portion forms the contact point 21. The linear portions 25 are formed on either side of the arcuate portion 23, and each form an angle of $\alpha$ with the horizontal, as shown in FIG. 3. The radius R and the angle $\alpha$ are chosen so that the weld areas apply a sufficient holding force on paper inserted within the plastic folder.

More specifically, the weld areas 20 are spaced from one another at a distance of c, wherein the distance c is chosen to be slightly smaller than the length of paper to be inserted into the plastic folder. As a non-limiting example, if 1–5 sheets of letter-size paper are to be inserted into the plastic folder, the distance c is chosen to be approximately 279 mm. As another non-limiting example, if 5–10 sheets of letter-size paper are to be inserted into the plastic folder, the distance c is chosen to be approximately 281.0 mm. Because the weld areas 20 are spaced slightly smaller than the length of the paper, they apply a holding force to the paper.

Further, the radius R, and angle $\alpha$, impact the holding force of the weld areas. If the radius R becomes too small and, correspondingly, the angle $\alpha$ becomes too large, then there is produced a small contact area at contact point 21 thereby reducing the sheet-holding force of the weld areas. On the other hand, if the radius R becomes too large and, correspondingly, the angle $\alpha$ becomes too small, then there is produced a large contact area at contact point 21, which large contact area causes an undesirably large deformation of the paper sheets in the plastic folder. The deformation can be judged to be too large when the paper sheets do not sit flat within the plastic folder. Preferably, an angle $\alpha$ of about 40° is used, so that the arcuate portion 23 subtends an angle of 80°, but the invention is not limited to such angles as long as the chosen angle $\alpha$ produces a sufficient holding force without too much deformation of the paper sheets.

As shown in FIG. 4, the weld area 20 includes a pattern of welded portions 22,24, wherein the welded portions alternate with non-welded portions. Further as shown in FIG. 4, the welded portions are arranged so that two larger welded portions 22 are located on the ends of the welded area 20, whereas relatively smaller welded portions 24 are located therebetween. Additionally, it is beneficial to have a wide weld portion such as 22 on the end of the weld area 20 adjacent to the fold lines 4,8 to prevent the weld from easily ripping. Preferably, as shown, the pattern of welded portions 22, 24 is symmetrical about the central vertical axis of the weld area. Such a symmetrical pattern of weld areas more simply produces a better weld when the weld is made by ultra-sonic energy, as is preferred. Although ultra-sonic welding is preferred, the welded portions 22, 24 may be produced by other manners of welding as, for example, high-frequency, heat, and pulse welding. Further, the width of the welded portions 24 is shown as being the same as that of the non-welded portions, and twice that of the welded portions 22. The above-described arrangement of welded portions 22,24 is preferred in order to make it easy to produce the weld areas 20 as well as to obtain a sufficient strength of the weld areas 20. The above-described shape of weld areas 20, together with the pattern of welded portions 22,24 as shown, produces a strong weld that is capable of providing sufficient holding force to paper sheets in the plastic folder. However, one drawback to this shape of weld area 20 is that although the linear welded portions 22,24 are easy to produce, a bubbling effect may be produced in the area 14 adjacent to the weld area 20. Such a bubbling effect may not be acceptable for high-quality reports, but may be okay when the plastic folder is used for other purposes.

Fold line 4 is positioned directly over fold line 8, as shown in FIG. 2. The fold lines 4,8, are designed to aid in the plastic holder's ability to retain paper. That is, the front cover 1 can be folded about fold line 4, and the back cover 2 can be folded about the fold line 8, which allows the papers within the plastic folder to be viewed without producing undue force on the weld areas 20. In other words, the covers 1 and 2 easily can be opened without affecting the plastic holder's sheet-holding force that is mainly produced by the weld areas 20. Additionally, because the fold lines 4,8 reduce the force on the weld areas, the weld areas are less likely to be damaged. Further, the fold lines 4,8 provide added rigidity to the hinge section of the plastic folder. That is, because of the fold lines 4,8, the hinge section is less likely to bow out under the condition where the plastic folder is held by the front 1 and back 2 covers so that the paper therein is allowed to hang downwardly. Because the hinge section is less likely to bow out, the sheets in the plastic folder are held more securely and, again, the weld areas 20 are less likely to be damaged.

The cutouts 10 are of an overall rectangular shape having two sides that are substantially parallel to the fold line 6 or spine 12. The cutouts 10 serve to reduce the stress concentration on the fold lines 4,8 and weld areas 20, which makes it harder to tear the weld areas 20 and the plastic folder. Each of the cutouts 10 is spaced a distance of b from the contact area 21 of a corresponding weld area 20, and is spaced a distance of a from the spine 12. Additionally, as shown in FIG. 2, both the cutouts 10 and the fold lines 4,8 are also spaced from the contact areas 21 by a distance of b. Although such similar spacings a, b are preferred to make it easier to fold the covers 1,2 along the fold lines 4,8, respectively, the spacing between the cutouts 10 and contact points 21, and the spacing between the fold lines 4,8 and the contact points 21, does not necessarily need to be the same. That is, the fold lines 4,8 can be to the left of the cutouts 10, to the right of the cutouts 10, or anywhere along the width of the cutouts 10. As noted above, however, in no event should the fold lines 4, 8 be spaced a distance greater than a from the spine 12 because such may make it hard to read the information on the paper within the plastic folder. In any event, the distance b is selected to minimize the bubbling effect in the area 14 adjacent to the weld areas 20. That is, by selecting an appropriate distance b the cutouts 10 relax the stress concentration on the fold lines 4,8, and the weld areas 20.

A second embodiment of the present invention will now be described with reference to FIGS. 5–7. The second embodiment of the invention is similar to the first in many respects and, therefore, similar reference numerals are used to designate similar features, with a detailed explanation thereof omitted.

Figure 5:
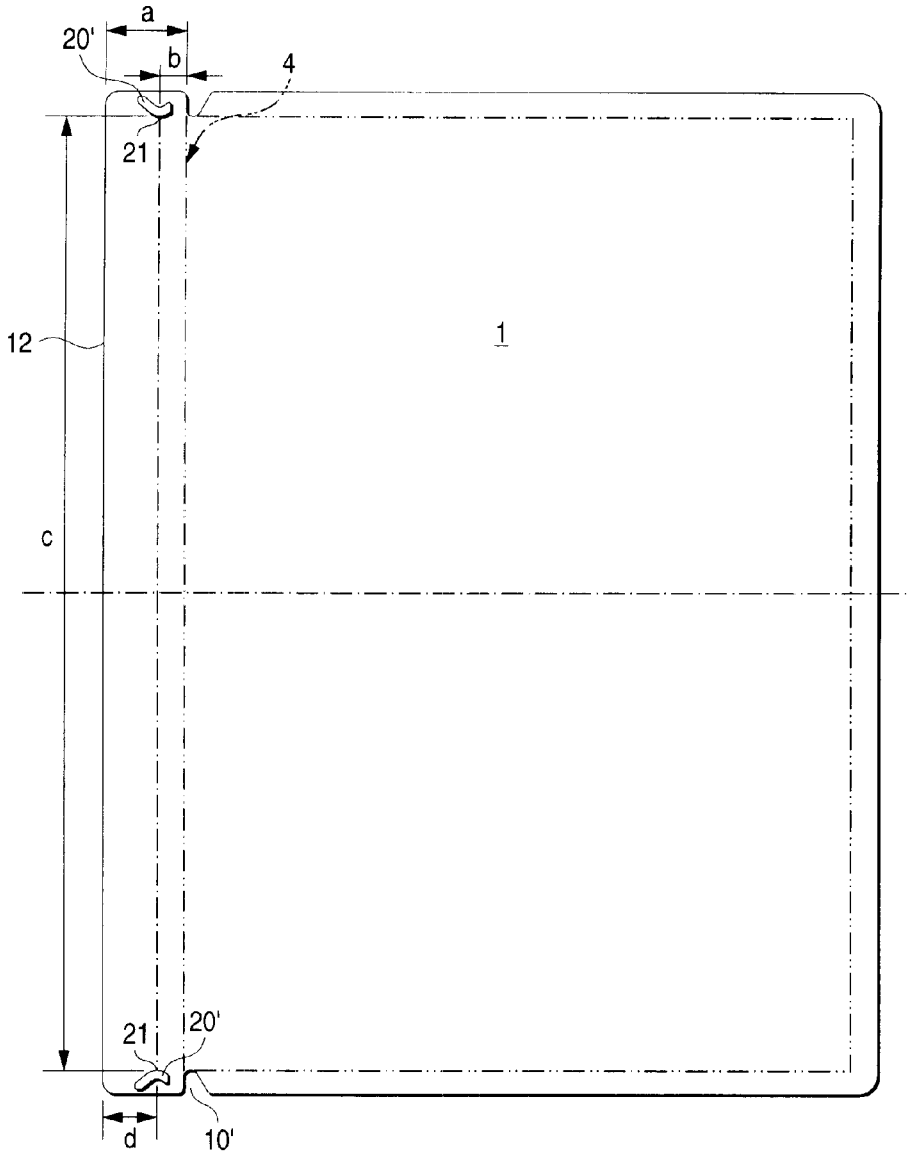
FIG. 5 is a flat layout of a plastic folder according to a second embodiment of the present invention.

FIG. 5 shows the second embodiment of the invention as including weld areas 20', spine 12, fold lines 4,8 (wherein fold line 8 is directly beneath fold line 4), and cutouts 10'.

Figure 6:
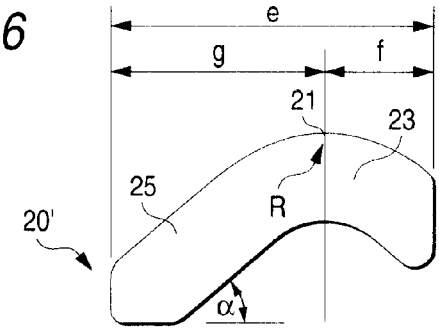
FIG. 6 is a blown-up, schematic, view of a weld area as shown in FIG. 5.
Figure 7:
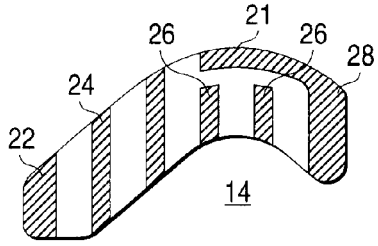
FIG. 7 is a blown-up, schematic, view of a weld area as shown in FIG. 5, wherein the pattern of welded portions is shown.

The weld areas 20' are shown in a blown-up manner in FIGS. 6 and 7, wherein FIG. 6 shows the overall configuration of the weld areas 20', and FIG. 7 shows the pattern of welded portions 22,24,26,28 within the weld area 20'. Each of the weld areas 20' generally includes a contact point 21, an arcuate portion 23, and a linear portion 25, which is a linear extension of the arcuate portion 23, and which extends toward the spine 12 from the arcuate portion 23.

As shown in FIG. 7, each weld area 20' includes a pattern of welded portions 22,24,26,28 wherein the welded portions alternate with non-welded portions. Further as shown in FIG. 7, the welded portions are arranged so that the linear portion 25 includes, from left to right as viewed in FIGS. 5 and 7, a weld portion 22, and two weld portions 24, with non-welded portions disposed between each two adjacent welded portions. Moreover, in the arcuate portion 23, from left to right as viewed in FIGS. 5 and 7, two short linear welded portions 26 and a lead welded portion 28 are disposed. There is a non-welded portion between the right-most welded portion 24 and the left-most welded portion 26, as well as between the two short linear welded portions 26. Lastly, there is a non-welded portion between each of the two short linear welded portions 26 and the lead welded portion 28. The lead welded portion 28 includes a lead edge that is shown as being the same width as the welded portion 22, although it need not be. As noted above, however, such is preferred to facilitate ultrasonic welding. Additionally, it is beneficial to have a wide weld portion on the end of the weld area 20' adjacent to the fold lines 4,8 to prevent the weld from easily ripping. Further, the lead welded portion 28 includes an arcuate segment extending from the lead edge back toward the spine 12, and over the two short linear welded portions 26. It is this arcuate segment of the lead welded portion 28 that forms the contact point 21, and which holds paper sheets within the plastic folder by compression. This pattern of welded portions 22,24,26,28 minimizes the bubble formation in area 14 adjacent to the weld area 20' and, when used in connection with cutouts 10', the bubble formation is eliminated. Although this pattern of welded portions assists in eliminating bubble formation, it is more complex than the linear welded portions in weld area 20.

The above-described shape of weld areas 20', together with the pattern of welded portions 22,24,26,28 as shown, produces a strong weld that is capable of providing sufficient holding force to paper sheets in the plastic folder.

The weld areas 20' are positioned a distance d from the spine 12. The distance d is chosen so that the contact points 21 of the weld areas 20' are slightly off from the center of a punched hole in the sheet of paper held within the plastic folder. That is, typically, the center of a hole in a sheet of paper is 12.5 mm from the edge adjacent to the spine, and the distance d is chosen to be 13.0 mm, for example. Such spacing produces an esthetically pleasing design, and also is less likely to damage the weld areas when the plastic folder is punched in a corresponding manner so as to enable it to be placed in a binder.

The fold lines 4,8 are the same as described above with respect to the first embodiment.

The cutouts 10' of the second embodiment, differ from the cutouts 10 only in their shape, but serve the same function—to reduce stress concentration on the fold lines 4,8 and weld areas 20', which makes it harder to tear the weld areas 20' and the plastic folder. Additionally, when used in connection with the weld areas 20', the cutouts 10' assist in eliminating the bubbling effect in the area 14 adjacent the weld areas 20'. The cutouts 10' have one side which is parallel to the fold line 6 or spine 12, and another side which is sloped relative to the first, and a curved section therebetween. As a non-limiting example, the sloped side may be positioned at an angle of 30° with respect to the side parallel to the spine 12. The shape of the cutouts is not particularly important, but the cutouts 10' are preferred, over the cutouts 10, as they are less likely to catch on other objects such as other papers, or a person's fingers. As a non-limiting example, when the cutouts 10' are positioned a distance b of 11 mm from the contact point 21 of the weld area 20'—when the weld area 20' has a length e of 9 mm, a length f of 3 mm, and a length g of 6 mm—they have the greatest effect in helping to eliminate the bubbling effect in area 14.

Again, in this embodiment as in the first embodiment, the distance b between the contact points 21 and the cutouts 10' preferably is the same as the distance between the contact points 21 and the fold lines 4,8. Additionally, both the cutouts 10' and the fold lines 4,8 preferably are positioned at the distance a from the spine. In this embodiment, the least desirable position of the fold lines 4,8, with respect to the cutouts 10, is in the curved sections of the cutouts 10' where the cutouts 10' are closest to each other. In such a position, it is easiest to rip the plastic folder along the fold lines 4,8 when opening the front 1 or back 2 covers, respectively.

The present invention is not limited to the specific above-described embodiments. It is contemplated that numerous modifications may be made to the plastic folder of the present invention without departing from the spirit and scope of the invention as defined in the following claims. For example, the weld areas 20 could be used with the cutouts 10'. Similarly, the weld areas 20' could be used with the cutouts 10. Further, for example, the weld areas 20 could be spaced at a distance d from the spine 12.

We claim:

1. A plastic folder for holding sheets of paper, comprising:

a front cover;

a back cover;

a binge section between said front cover and said back cover, wherein said hinge section includes a first fold line adjacent said front cover, a second fold line adjacent said back cover, and a third fold line intermediate said first and second fold lines, said third fold line forming a spine so that said front cover is disposed over said back cover and so that said first fold line is over said second fold line, wherein a first hinge portion is disposed between said third fold line and said first fold line, whereas a second hinge portion is disposed between said third fold line and said second fold line;

a first weld area disposed on said hinge section so as to be between said spine and said first fold line, wherein said first weld area connects said first hinge portion to said second hinge portion;

a second weld area disposed on said hinge section so as to be between said spine and said first fold line, wherein said second weld area connects said first hinge portion to said second hinge portion, wherein said second weld area is disposed at a first distance in the direction of said spine from said first weld area, said first distance being smaller than a length of an edge of a sheet of paper to be disposed along said spine so that the sheet of paper is held within said plastic folder by said first and second weld areas; and a cutout disposed between said first weld area and an edge of said plastic folder which is opposite to said spine when said front cover is disposed over said back cover, and a cutout disposed between said second weld area and the edge of said plastic folder, wherein said cutouts reduce stress on said first and second fold lines and said first and second weld areas.

2. The plastic folder according to claim 1, wherein said first weld area and said second weld area are aligned on axial lines that are parallel to each of said first, second and third fold lines.

3. The plastic folder according to claim 1, wherein said first weld area is not folded when said front cover is folded about said first fold line, and said second weld area is not folded when said back cover is folded about said second fold line.

4. The plastic folder according to claim 1, wherein each of said cutouts includes a first side that is substantially parallel to said first fold line.

5. The plastic folder according to claim 4, wherein each of said cutouts further includes a second side that is sloped relative to said first side.

6. The plastic folder according to claim 1, wherein said first weld area comprises an arcuate portion, and a first linear portion extending from said arcuate portion toward said spine.

7. The plastic folder according to claim 6, wherein said first weld area comprises linear welded portions extending in a direction substantially parallel to said spine.

8. The plastic folder according to claim 7, wherein said first weld area further comprises a welded portion having an arcuate segment.

9. The plastic folder according to claim 6, wherein said first weld area further comprises a second linear portion extending from said arcuate portion, said second linear portion being disposed on an opposite side of said arcuate portion than is said first linear portion.

10. The plastic folder according to claim 6, wherein an apex of said arcuate portion forms a contact point contacting sheets of paper.

* * * * *